US006322423B1

(12) United States Patent
Heijkenskjöld

(10) Patent No.: US 6,322,423 B1
(45) Date of Patent: Nov. 27, 2001

(54) INTERNAL ABRASIVE MACHINE

(75) Inventor: Mats Heijkenskjöld, Träffberg (SE)

(73) Assignee: Lidkoping Machine Tools AB, Lidkoping (SE)

( * ) Notice: Subject to any disclaimer, the term of this patent is extended or adjusted under 35 U.S.C. 154(b) by 0 days.

(21) Appl. No.: 09/446,933

(22) PCT Filed: Jul. 3, 1998

(86) PCT No.: PCT/SE98/01311

§ 371 Date: Dec. 30, 1999

§ 102(e) Date: Dec. 30, 1999

(87) PCT Pub. No.: WO99/01254

PCT Pub. Date: Jan. 14, 1999

(30) Foreign Application Priority Data

Jul. 4, 1997 (SE) ..... 9702587

(51) Int. Cl.[7] ..... B24B 51/00
(52) U.S. Cl. ..... 451/27; 451/10; 451/180
(58) Field of Search ..... 451/27, 180, 10, 451/8, 5, 21, 51, 52, 56

(56) References Cited

U.S. PATENT DOCUMENTS

| | | | | |
|---|---|---|---|---|
| 3,817,149 | | 6/1974 | Reutlinger . | |
| 4,112,624 | * | 9/1978 | Uhtenwoldt et al. | 451/180 |
| 4,112,629 | * | 9/1978 | Possati | 451/27 |
| 4,513,540 | * | 4/1985 | Dzewaltowski et al. | 451/27 |
| 4,831,785 | * | 5/1989 | Sigg | 451/27 |
| 4,845,895 | * | 7/1989 | Kihara et al. | 451/180 |
| 4,854,087 | | 8/1989 | Riha . | |
| 4,956,945 | * | 9/1990 | Ooshima | 451/27 |
| 5,042,204 | * | 8/1991 | Johnson | 451/180 |
| 5,044,125 | * | 9/1991 | Lambert, Jr. et al. | 451/27 |
| 5,072,550 | * | 12/1991 | Matsumoto | 451/27 |
| 5,086,592 | * | 2/1992 | Schreiber | 451/180 |
| 5,205,078 | * | 4/1993 | Takara et al. | 451/27 |
| 5,259,156 | | 11/1993 | Ronen . | |

FOREIGN PATENT DOCUMENTS 1 232 135 5/1971 (GB) .

* cited by examiner

*Primary Examiner*—M. Rachuba
(74) *Attorney, Agent, or Firm*—Burns, Doane, Swecker & Mathis, L.L.P.

(57) ABSTRACT

An internal abrasive machine abrades material from an inner surface of a workpiece. The machine includes a casing rotated about a first axis, with a workpiece rotated therewith about the first axis. A housing is disposed coaxially inside of the casing, and a shaft is mounted eccentrically in the housing. The casing and housing are angularly movable relative to one another. A drivable spindle is mounted in the shaft, the spindle carrying an abrasive tool. The spindle is offset eccentrically with respect to the first axis and carries an abrasive tool disposed inside the workpiece. A motor is provided to produce relative angular movement between the housing and the shaft to displace the spindle laterally with respect to the first axis and into contact with the inner surface of the workpiece.

12 Claims, 3 Drawing Sheets

INTERNAL ABRASIVE MACHINE

BACKGROUND OF THE INVENTION

The present invention relates to an internal abrasive machine, i.e. a machine tool designed for removing material from the inner envelope surface of annular work pieces, and particularly an internal grinding machine for grinding the bore of bearing rings and of the type defined in the preamble of the accompanying claim 1.

Abrasive machines such as grinding machines, lapping machines, honing machines, milling machines, etcetera, are known in many slightly different designs and embodiments. It is desirous that the machine is compact and as space-saving as possible. For obtaining a good machining result on the other hand it is important that the co-operating parts of the machine has a high mutual stiffness and low tendencies of vibration. These last-mentioned properties are often obtained by giving the machine a heavy bedding and a sturdy and robust design, and therefore these two requirements are often contradictory to the desires for compactness and space-saving properties.

SUMMARY OF THE INVENTION

The purpose of the present invention is to provide an internal abrasive machine which fulfils these, partly contradictory properties, and this has been obtained by an internal abrasive machine for abrading material from an inner surface of a workpiece. The machine comprises a hollow casing mounted in a support structure for rotation about a first longitudinal axis. The casing forms a first inner space. A lid is fixed to a longitudinal end of the casing. A first drive mechanism is connected to the casing for rotating the casing and the lid about the first longitudinal axis. A clamp is provided for clamping a workpiece to the lid for rotation therewith about the first longitudinal axis. A housing is mounted in the first inner space and forms a cylindrical second space having a second longitudinal axis arranged parallel to and offset from the first longitudinal axis. A shaft is mounted in the second inner space, wherein the housing and the shaft are angularly movable relative to one another. The shaft forms a third inner space. A second drive mechanism is mounted in the third inner space. A spindle is connected to the second drive mechanism and it defines a spindle axis extending eccentrically relative to the first longitudinal axis. The spindle is connected to the second drive mechanism to be rotated thereby about the spindle axis. An abrasive tool is fixed to an outer end of the spindle for rotation therewith. A third drive mechanism is connected to the shaft for displacing the shaft and the spindle in a direction coinciding with the spindle axis into and from the inner surface of the workpiece. A fourth drive mechanism is connected to one of the housing and the shaft for producing relative rotation between the housing and the shaft to angularly displace the spindle in a direction extending laterally relative to the first longitudinal axis for bringing the abrasive tool into contact with the inner surface of the workpiece.

BRIEF DESCRIPTION OF THE DRAWINGS

Hereinafter the invention will be further described with reference to an embodiment schematically shown in the accompanying drawings.

DETAILED DESCRIPTION OF A PREFERRED EMBODIMENT OF THE INVENTION

Figure 1:
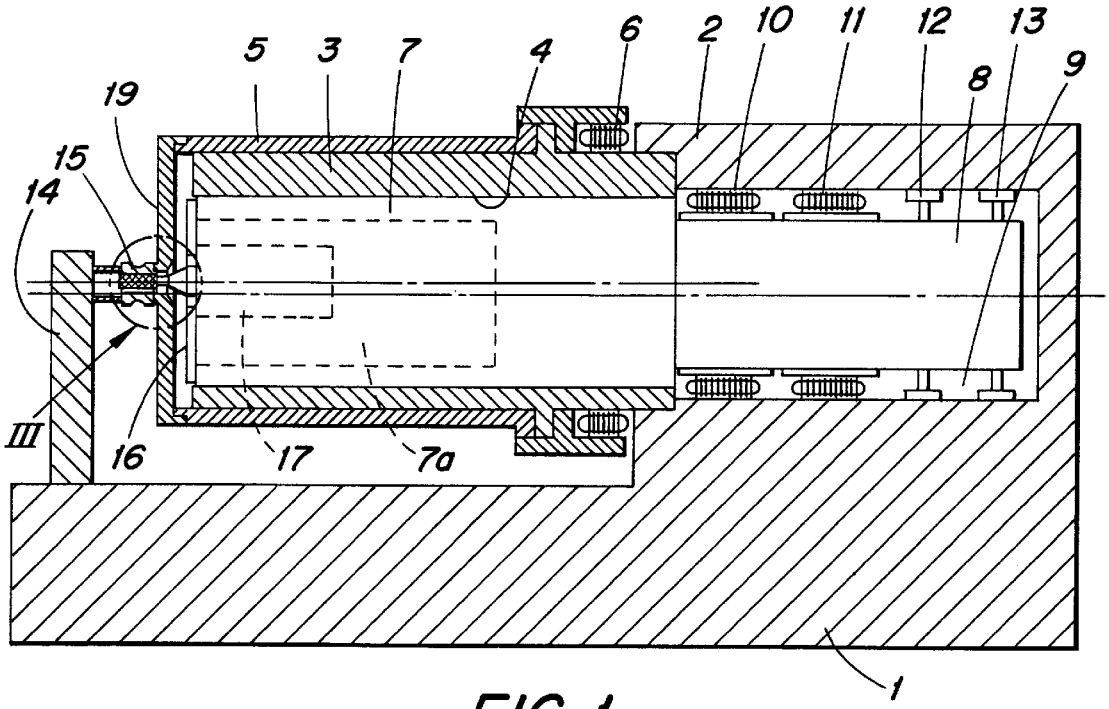
FIG. 1 shows in a longitudinal section a schematical embodiment of the abrasive machine according to the invention.
Figure 2:
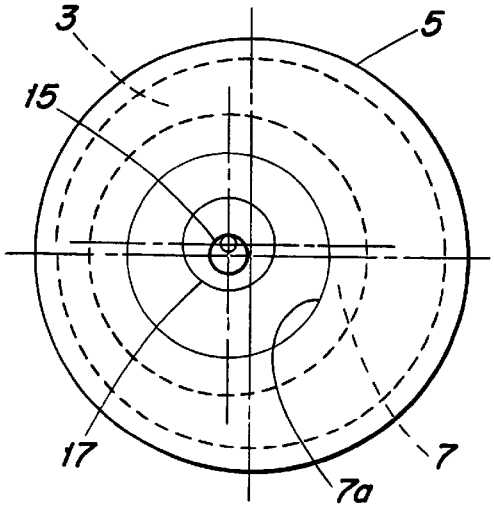
FIG. 2 is an end view of a portion of the machine as shown in FIG. 1.

FIG. 1 of the drawing shows schematically the main components of a new internal abrasive machine, in this embodiment construed as a grinding machine according to the present invention. Thus the machine incorporates a frame 1, in the embodiment intimated, designed as a machine bed having a portion 2 for supporting a cantilever housing, which is designed as an externally cylindrical and substantially tube-shaped elongated member 3 having a longitudinally extending bore 4, which is arranged eccentrically in relation to the longitudinal centre of the cylindrical member 3. The cylindrical member 3 is preferably—although not necessarily—non-rotatably connected to the frame 1. Rotatably supported on the outer envelope surface of the cylindrical member 3 is a rotatable outer member 5, a work head, which is driven by a motor 6, preferably an electric motor. Inside the eccentric bore 4 of the housing, there is provided a shaft 7 which can be revolved and displaced axially. This shaft 7 has a portion 8 projecting out from the housing bore 4 in a direction towards the supporting portion 2 of the frame 1, and in the embodiment intimated in the drawing, having smaller diameter than the portion of the shaft 7 received in the housing. In the embodiment shown the portion 8 of the shaft, thus projecting from the housing is received in a space 9 provided in the portion 2 of the frame 1, and in which space is provided means for revolving the shaft 7, preferably a torque motor 10 and means for axial displacement of the shaft 7, preferably on the form of a linear motor 11. The revolving and the axial displacement of the shaft is controlled by sensors 12 and 13 respectively, which are also contained in the space 9 of the frame portion 2.

It also is evident that the means for revolving and axially displacing the shaft, need not be arranged in a manner as shown in the drawing, but they may for instance be provided in a recessed portion of the shaft itself.

The frame 1 also supports a carrier 14 for an appropriate and not further shown chuck for a work piece 15, e.g. a bearing race ring, the bore of which is to be ground. At its end opposite its projecting portion 8, the shaft 7 has an inner space 7*a*, in which is supported a motor 17 with integrated grinding spindle 16, and which grinding spindle carries a grinding wheel 18 at its outermost end. The rotatable outer member 5, or the work head, which thus is tubular, at its front end, i.e. the end thereof adjacent the free end of the cylindrical member 3, extends slightly outside the cylindrical member 3 and is provided with a firmly connected lid member 19 having a centre opening 20 (see FIG. 3). In operation the grinding spindle 16 projects through this centrum opening 20, thus that the grinding wheel 18 attached to said spindle can be displaced between positions outside and inside the lid member 19, following axial movement by the shaft 7, imparted thereto by the linear motor 11. The opening 20 in the lid member 19 is of such a size that it permits the grinding spindle 16 and also the grinding wheel 18 to pass therethrough with sufficient clearance to allow the shaft 7—and thereby the grinding spindle 16—to be revolved eccentrically relative to the lid member opening 20, thereby angularly displacing the said spindle 16 with the tool 18 in a path allowing the tool surface to approach and contact the inner periphery of a work piece clamped between the chucking equipment 14 and the lid member.

For effecting dressing or trueing of the grinding wheel 18 or similar tool the hole wall of said opening 20 is preferably provided with a material 71 and by moving the tool through the opening 20 in such a manner that it approaches and contacts this material the grinding wheel is given a desired or appropriate profile.

Figure 3:
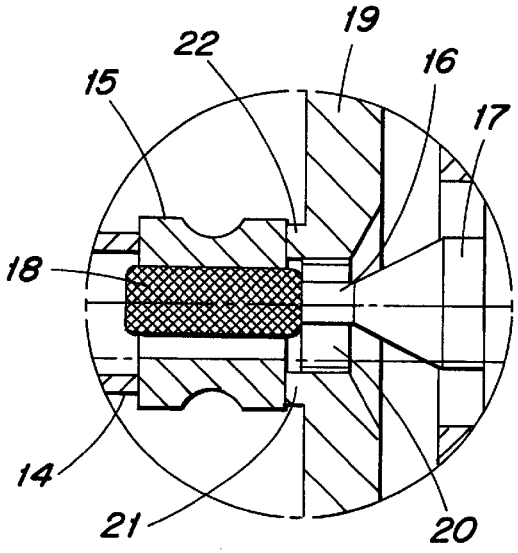
FIG. 3 is an enlargement of the encircled portion of FIG. 1.

As better seen in FIG. 3, which is an enlargement of the encircled portion of FIG. 1, the lid member 19 of the rotatable outer member 5 has a flange portion 22 encircling the opening 20 and projecting outwardly. This flange member 22 in this embodiment co-operates with the chuck member 14 in such a manner that the work piece 15 will be clamped between the chuck 14 and the flange 22, which rotates together with the rotatable outer member 5, thereby causing the work piece to rotate about its axis. It also is evident that the chucking method used is of no vital importance for the present invention, and any of the conventional chucking methods can be used, i.e. centric chucking (as intimated), micro-centric chucking or magnetic chucking.

In FIGS. 4–7 is shown in intimated cross sections different embodiments of how the main components of the abrasive machine according to the invention can be arranged and displaced angularly relative to each other.

Figure 4:
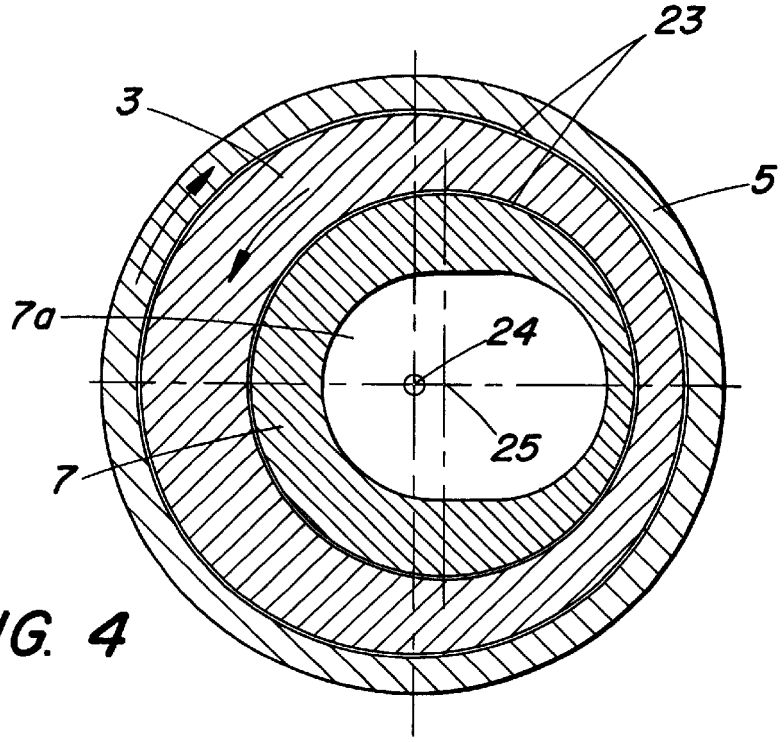

FIG. 4 thus shows how the main components, outer casing 5, housing 3 and shaft 7, with its inner space 7*a* are disposed in accordance with the embodiment shown in FIG. 1. In this embodiment the casing 5 rotates about the fixed, non-rotating housing 3, whereas the shaft 7 with aid of its motor 10 (FIG. 1) can be turned relative to the housing. For this purpose the surfaces between housing 3 and casing 5 and between housing 3 and shaft 7 are formed as bearing surfaces 23.

As seen from this figure, where the shaft and its inner space 7*a* is shown without any motor inserted the space 7*a* in this embodiment is formed as an oblong bore. Thereby it is possible to insert motors of different size and also to position them at different positions offset from the centre 24 of the housing.

From the figure it is also clearly visible how the centre 25 is offset from the centre of the housing.

Figure 5:
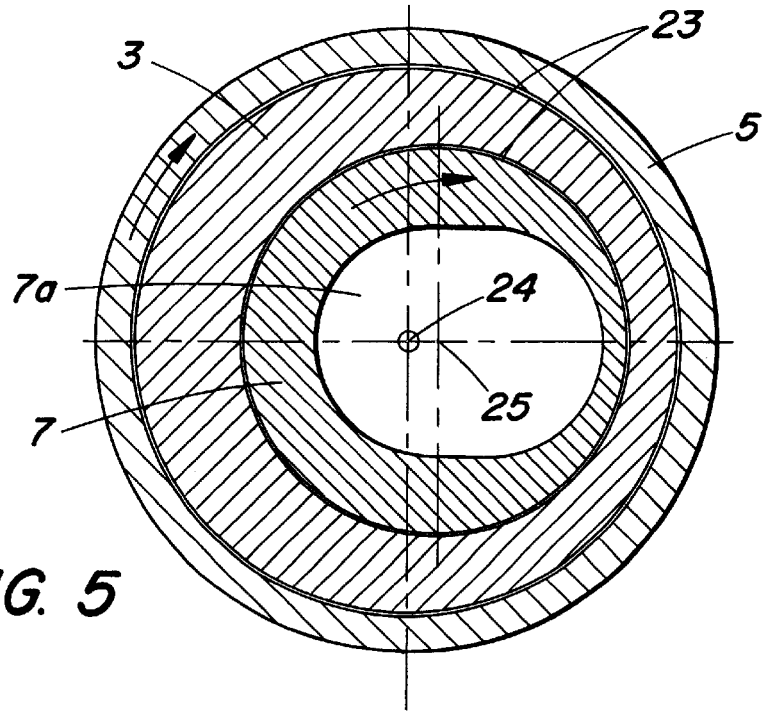
FIGS. 4–7 show diagrammatical cross sections of an end view according to FIG. 2 with the different elements of the machine in different mutual positions.

FIG. 5 shows an embodiment, which in the drawing looks alike that of FIG. 4, but which differs slightly in that the shaft 7 can be affixed and angularly immobile, whereas the housing member 3 can be turned relative to the shaft 7. The casing 5 also in this case is rotatable and bearing surfaces 23 are provided between casing 5 and housing 3 and between housing 3 and shaft 7.

Figure 6:
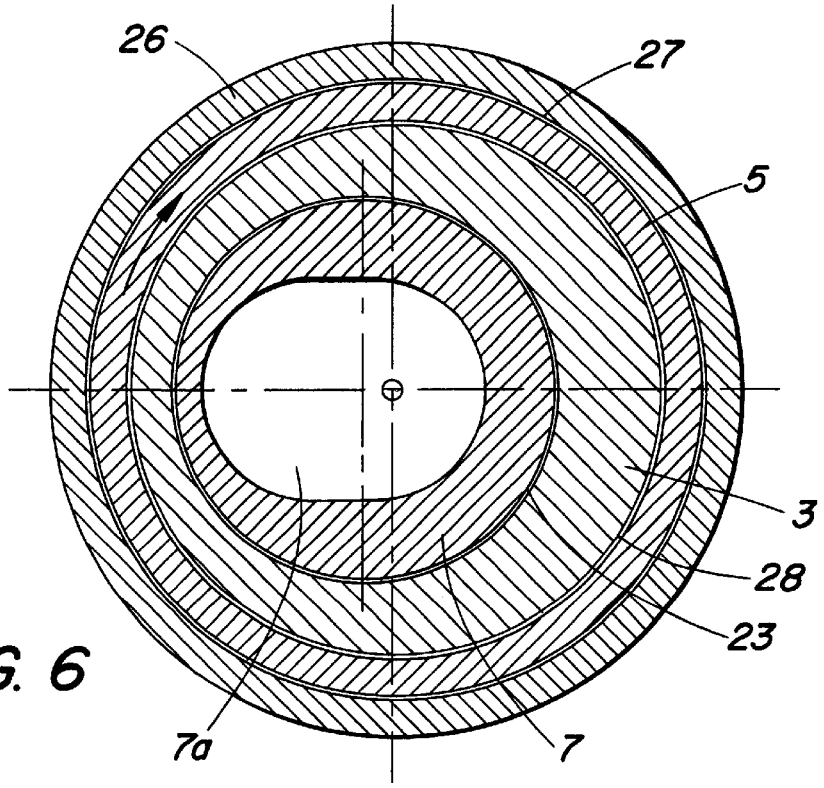
Figure 7:
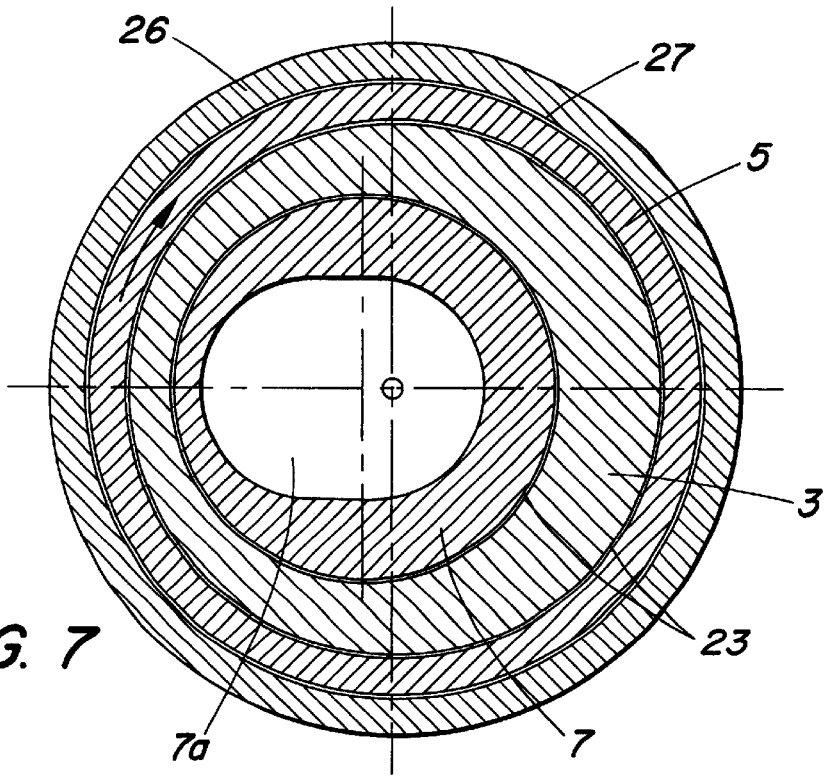

FIG. 6 shows another possible embodiment, wherein the casing 5 is provided inside an outer fixed structure 26 with a bearing surface 27 provided therebetween. Between the casing 5 and the fixed housing 3 there is in this case no bearing surface but a clearance In the embodiment intimated in FIG. 7 there is provided a fixed outer structure 26 like in the embodiment shown in FIG. 6, but in this case there are provided bearing surfaces 23 also between the outer casing 5 and the housing 3, which last-mentioned is prevented from rotating,.

The invention is not limited to the embodiment shown in and described in connection to the accompanying drawings, but modifications and variations are possible within the scope of the accompanying claims.

Thus it can be mentioned that in the embodiment described and shown in the drawings, the cylindrical housing has been shown having a cylindrical inner space, but in spite of this it is possible that this space has other than a cylindrical shape and that the shaft has any appropriate cross sectional form allowing it to be turned or indexed inside the inner space of the housing. The shaft may even be designed as the housing of the very spindle, and it is even possible to substitute the shaft for a system of articulated links or the like capable of turning or indexing the spindle in an appropriate manner.

What is claimed is:

1. An internal abrasive machine for abrading material from an inner surface of a workpiece, the machine comprising:

a hollow casing mounted in a support structure for rotation about a first longitudinal axis, the casing forming a first inner space; lid fixed to a longitudinal end of the casing;

a first drive mechanism connected to the casing for rotating the casing and the lid about the first longitudinal axis;

a clamp for clamping a workpiece to the lid for rotation therewith about the first longitudinal axis;

a housing mounted in the first inner space and forming a cylindrical second space having a second longitudinal axis arranged parallel to and offset from the first longitudinal axis;

a shaft mounted in the second inner space, wherein the housing and the shaft are angularly movable relative to one another, the shaft forming a third inner space;

a second drive mechanism mounted in the third inner space;

a spindle connected to the second drive mechanism and defining a spindle axis extending eccentrically relative to the first longitudinal axis, the spindle being connected to the second drive mechanism to be rotated thereby about the spindle axis;

an abrasive tool fixed to an outer end of the spindle for rotation therewith;

a third drive mechanism connected to the shaft for displacing the shaft and the spindle in a direction coinciding with the spindle axis into and from the inner surface of the workpiece; and a fourth drive mechanism connected to one of the housing and the shaft for producing relative rotation between the housing and the shaft to angularly displace the spindle in a direction extending laterally relative to the first longitudinal axis for bringing the abrasive tool into contact with the inner surface of the workpiece.

2. The machine according to claim 1 further including a stationary hollow supporting frame defining a recess, an end of the shaft disposed opposite the spindle mounted in the recess.

3. The machine according to claim 2 wherein the second rotary drive mechanism is disposed in the recess.

4. The machine according to claim 3 wherein the linear drive mechanism is disposed in the recess.

5. The machine according to claim 2 wherein the linear drive mechanism is disposed in the recess.

6. The machine according to claim 1 wherein the second rotary drive mechanism includes a motor carrying the spindle, the third inner space being larger than the motor, to enable the motor and the spindle to be adjustably moved relative to the first longitudinal axis.

7. The machine according to claim 2 wherein the housing is fixed to the supporting frame, the first drive mechanism comprising a motor carried by the housing.

8. The machine according to claim 7 wherein the lid is solid except for an opening formed therethrough along the first longitudinal axis, the spindle projecting through the opening.

9. The machine according to claim 8 wherein the third drive mechanism is operable to retract the shaft inwardly far enough to bring the tool to a position wherein it does not emerge out of the opening.

10. The machine according to claim 9 wherein the lid carries a dressing material located for dressing the tool when the tool is retracted into the opening.

11. The machine according to claim 1 further including sensors mounted on the shaft for sensing a position of the shaft.

12. The machine according to claim 1 wherein each of the four drive mechanisms includes an electric motor.

* * * * *